United States Patent [19]

Elms

[11] Patent Number: 4,506,195

[45] Date of Patent: Mar. 19, 1985

[54] APPARATUS FOR OPERATING HID LAMP AT HIGH FREQUENCY WITH HIGH POWER FACTOR AND FOR PROVIDING STANDBY LIGHTING

[75] Inventor: Robert T. Elms, Monroeville, Pa.

[73] Assignee: North American Philips Lighting Corporation, New York, N.Y.

[21] Appl. No.: 464,435

[22] Filed: Feb. 4, 1983

[51] Int. Cl.[3] ..... H05B 37/00

[52] U.S. Cl. ..... 315/205; 315/247; 315/268

[58] Field of Search ..... 315/177, 207, 92, 90, 315/88, 205, 219, 247, 258

[56] References Cited

U.S. PATENT DOCUMENTS

| | | | |
|---|---|---|---|
| 2,358,810 | 9/1944 | Karash | 315/247 |
| 2,828,420 | 3/1958 | Suozzi | 315/247 |
| 3,771,014 | 11/1973 | Paget | 315/243 |
| 3,927,348 | 12/1975 | Zawadski | 315/88 |
| 4,045,711 | 8/1977 | Pitel | 315/278 |
| 4,060,752 | 11/1977 | Walker | 315/283 |
| 4,109,307 | 8/1978 | Knoll | 315/247 |
| 4,232,252 | 11/1980 | Peil | 315/92 |

*Primary Examiner*—David K. Moore

*Attorney, Agent, or Firm*—Robert T. Mayer; Bernard Franzblau

[57] ABSTRACT

Ballast apparatus operates a HID lamp at high frequency and high power factor. Series-connected current-limiting input inductor and input capacitor connect across apparatus input and are tuned off resonance to pass predetermined lagging current. An additional input capacitor is connected across input terminals to that input power factor approaches unity. Full-wave diode bridge has input connected across series-connected input capacitor and filter capacitor connects across bridge rectifier output. During normal operation, the filter capacitor develops a DC potential which is current limited by series-connected inductor and capacitor. Inverter has input connected across filter capacitor and inverter an output that drives the HID lamp through a high-voltage generating and variable impedance resonant circuit. When HID lamp is not operating, resonant circuit impresses high voltage across lamp to start same in warm or cold condition and resonant circuit exhibits relatively low impedance which decreases current-limited potential across filter capacitor. When HID lamp is normally operating, resonant circuit exhibits relatively high impedance which increases DC potential across filter capacitor. Additional pair of series-connected diodes connect across bridge rectifier output and incandescent lamp connects between predetermined input terminal and voltage responsive control and switching means, which connects to interconnection of additional diodes. Voltage responsive switching means responds to decreased voltage across filter capacitor when HID lamp is not operating to energize standby incandescent lamp. When HID lamp is operating, voltage-responsive switching means responds to increased voltage across filter capacitor to maintain incandescent lamp de-energized.

18 Claims, 2 Drawing Figures

APPARATUS FOR OPERATING HID LAMP AT HIGH FREQUENCY WITH HIGH POWER FACTOR AND FOR PROVIDING STANDBY LIGHTING

CROSS-REFERENCE TO RELATED APPLICATION

In copending application Ser. No. 347,274, filed Feb. 11, 1982 by J. M. Hicks et al., and owned by the present assignee, there is disclosed a starting and operating method and apparatus for an HID lamp wherein inductors and a capacitor are included in separate branches on one side of the AC input which is used to energize a 3-phase full-wave rectifier bridge, with lamp starting accomplished by a resonant circuit.

BACKGROUND OF THE INVENTION

This invention relates to starting and operating apparatus for HID lamps and, more particularly, to such starting and operating apparatus which operate HID lamps at high frequency and with high power factor and which also provide standby incandescent lighting.

Miniature high-pressure metal-vapor discharge lamps are described in U.S. Pat. No. 4,161,672, dated July 19, 1979 to Cap et al. Such lamps are known to have potential utility as screw-in replacements for incandescent lamps. These lamps operate efficiently at predetermined high frequencies as disclosed in U.S. Pat. No. 4,170,746, dated Oct. 9, 1979 to Davenport. In the usual case, with DC or high-frequency operation, it is normally required that the available AC be rectified and filtered which substantially reduces the power factor of the operating system. This is undesirable and in many European markets, for example, high power factor operation is a requirement.

It is known to operate discharge lamps with a rectified current wherein a current-limiting impedance is included in the line prior to rectification and such a mode of operation is shown in U.S. Pat. No. 3,787,751, dated Jan. 22, 1974 to Farrow. A variety of such arrangements are also shown in U.S. Pat. No. 4,084,217, dated Apr. 11, 1978 to Bradli et al and U.S. Pat. No. 4,187,449, dated Feb. 5, 1982 to Knoble. Another system is described in the referenced copending application Ser. No. 347,274, filed Feb. 11, 1982 by J. M. Hicks et al.

When HID lamps are first started, they normally require a short time up to a few minutes, depending on the lamp design, to warm up and generate operating pressure within the envelope in order to produce full light output. In addition, after momentary periods of power interruption, the lamps normally must cool down at least to a warm condition before they can be reignited, after which the pressure must build up again to achieve rated light output. It is known to provide standby incandescent lighting for such lamps and a wide variety of circuits are available. One such standby lighting system is disclosed in U.S. Pat. No. 3,517,254, dated June 23, 1970 to McNamara. Another type of standby lighting system is disclosed in U.S. Pat. No. 3,723,808, dated Mar. 27, 1973 to Jones. U.S. Pat. No. 4,170,744, dated Oct. 9, 1979 to Hansler discloses a standby lighting system for use with a miniature metal-vapor lamp, with the combination formed as a screw-in light source.

SUMMARY OF THE INVENTION

There is provided ballast apparatus for operating HID lamp means at a high frequency and with a high power factor from an AC power source. The apparatus comprises input terminals adapted to be connected to the AC power source and apparatus output terminal across which the HID lamp is adapted to be connected. A series-connected current-limiting input inductor and input capacitor are connected across the apparatus input terminals with the reactances being so selected that the series combination is tuned off resonance to pass a predetermined lagging current. An additional input capacitor of predetermined reactance is connected across the apparatus input terminals so that the electric energy drawn by the combined inductor and capacitors at least approaches unity power factor. A full-wave diode bridge rectifier has an input connected across the series-connected input capacitor and a filter capacitor is connected across the output of the bridge-rectifier. During operation of the apparatus, the filter capacitor exhibits thereacross a DC potential which is current-limited by the series-connected current-limiting input inductor and input capacitor. An inverter has its input connected across the filter capacitor in order to convert the current-limited DC to high-frequency AC, with the output of the inverter connected to the apparatus output terminals to operate the HID lamp.

In its preferred form, a pair of additional series-connected diodes are connected anode-to-cathode across the bridge rectifier output and in current additive relationship to the diodes comprising the bridge rectifier. Also, the output of the inverter connects through high-voltage generating and variable impedance resonant circuit means to the apparatus output terminals. When the HID lamp is not operating, the resonant circuit impresses a high voltage across the apparatus output terminals to start the lamp in a warm or a cold condition and the resonant circuit exhibits a relatively low impedance which in turn substantially decreases the current-limited DC potential which is generated across the filter capacitor. When the HID lamp is normally operating, there is applied across the apparatus output terminals the predetermined high frequency potential as required to maintain the operation of the lamp and the resonant circuit exhibits a relatively high impedance which results in substantially increased current-limited DC potential being generated across the filter capacitor. A standby incandescent lamp has one terminal which is adapted to be connected to the input terminal of the ballast apparatus to which the input inductor directly connects. A voltage responsive control and switching means connects between the other terminal of the incandescent lamp and the interconnection of the anode and cathode of the pair of additional diodes. The voltage responsive control and switching means is responsive to the decreased voltage developed across the filter capacitor when the HID lamp is not operating to energize the incandescent lamp in order to provide standby lighting. When the HID lamp is normally operating, the voltage-responsive control and switching means is responsive to the increased voltage developed across the filter capacitor to maintain the incandescent lamp in a de-energized state.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
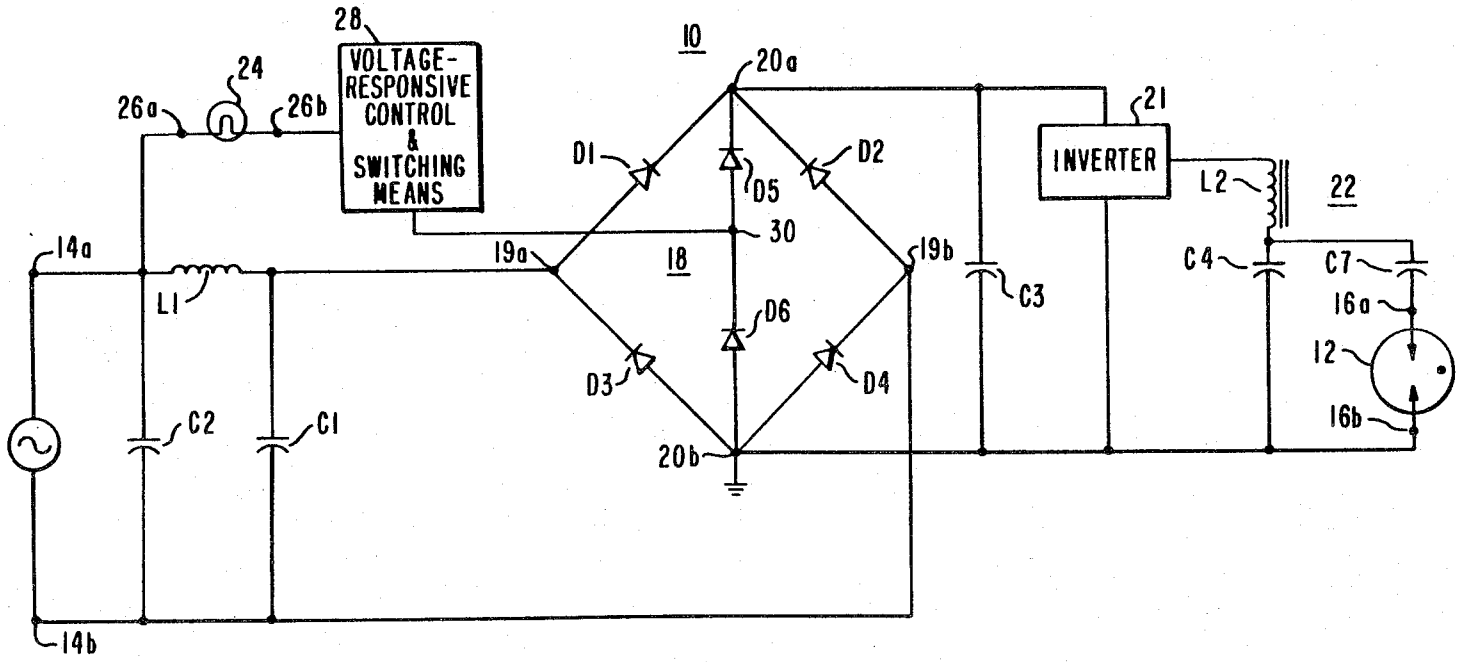
FIG. 1 is a simplified schematic diagram showing essential elements of the present apparatus.

In the simplified circuit diagram as shown in FIG. 1, there is provided a ballast apparatus 10 for operating a HID lamp 12, preferably a miniature metal-halide lamp, at a high frequency and with a high power factor from an AC power source. The ballast apparatus comprises apparatus input terminals 14*a*, 14*b* adapted to be connected across the source of predetermined rated AC power, such as 220 volts 50 Hz or 60 Hz, and apparatus output terminals 16*a*, 16*b* across which the HID lamp 12 is adapted to be connected. A typical rating for the HID lamp 12 is 35 watts.

A series-connected current-limiting input inductor L1 and input capacitor C1 connect across the apparatus input terminals 14*a*, 14*b*, with the series-connected input inductor L1 and input capacitor C1 having such predetermined reactance values that the series combination will pass a lagging current, such as 0.35 amp, since the inductive reactance significantly exceeds the capacitive reactance. Thus, inductor L1 and capacitor C1 provide a low frequency (60 Hz) current limiting series resonant LC circuit operating a little above its resonant frequency. An additional input capacitor C2 of predetermined reactance connects across the apparatus input terminals 14*a*, 14*b* so that the electrical energy drawn by the combined series-connected input inductor L1 and input capacitor C1 and additional input capacitor C2 at least approaches unity power factor.

A full-wave diode bridge rectifier 18 comprising diodes D1–D4 has an input 19*a*, 19*b* connected across the series-connected input capacitor C1 and a filter capacitor C3 connects across the output 20*a*, 20*b* of the bridge rectifier 18. A pair of additional diodes D5 and D6 are connected anode-to-cathode across the bridge rectifier output 20*a*, 20*b* and in current additive relationship with respect to the diodes D1–D4. During operation of the apparatus, the filter capacitor C3 exhibits thereacross a DC potential which is current-limited by the series-connected current limiting input inductor L1 and input capacitor C1. An inverter means 21 having an input connected across the filter capacitor C3 converts the current-limited DC potential to high-frequency AC potential and the output of the inverter electrically connects to the apparatus input terminals 16*a*, 16*b* through a high-voltage generating and variable impedance resonant circuit 22. In the operation of the apparatus, prior to lamp starting the inductor L2 and capacitor C4 form a high-Q resonant circuit which impresses a high voltage across the apparatus output terminals 16*a*, 16*b* which is sufficient to start the lamp 12. After the lamp 12 starts, the additional capacitor C7 operates in series with the lamp 12 to lower the resonant frequency and the added resistance of the operating lamp 12 forms a part of the resonant circuit 22 so that its impedance is increased. This in turn acts to increase the voltage across the filter capacitor C3.

An incandescent lamp 24 has a pair of input terminals 26*a*, 26*b*, and the terminal 26*a* is adapted to be connected to the input terminal 14*a* of the ballast apparatus 10 to which the input inductor L1 directly connects. There is provided a voltage-responsive control and switching means 28 which connects between the other terminal 26*b* of the incandescent lamp 24 and the interconnection 30 of the anode and cathode of the pair of additional diodes D5 and D6. The voltage-responsive control and switching means 28 is responsive to the decreased voltage developed across the filter capacitor C3 when the HID lamp 12 is not operating to energize the incandescent lamp 24 to provide standby illumination. When the HID lamp is normally operating, the voltage-responsive control and switching means 28 is responsive to the increased voltage developed across the filter capacitor C3 in order to maintain the incandescent lamp 24 in a de-energized condition. The general circuit as described will be considered in much greater detail hereinafter.

Figure 2:
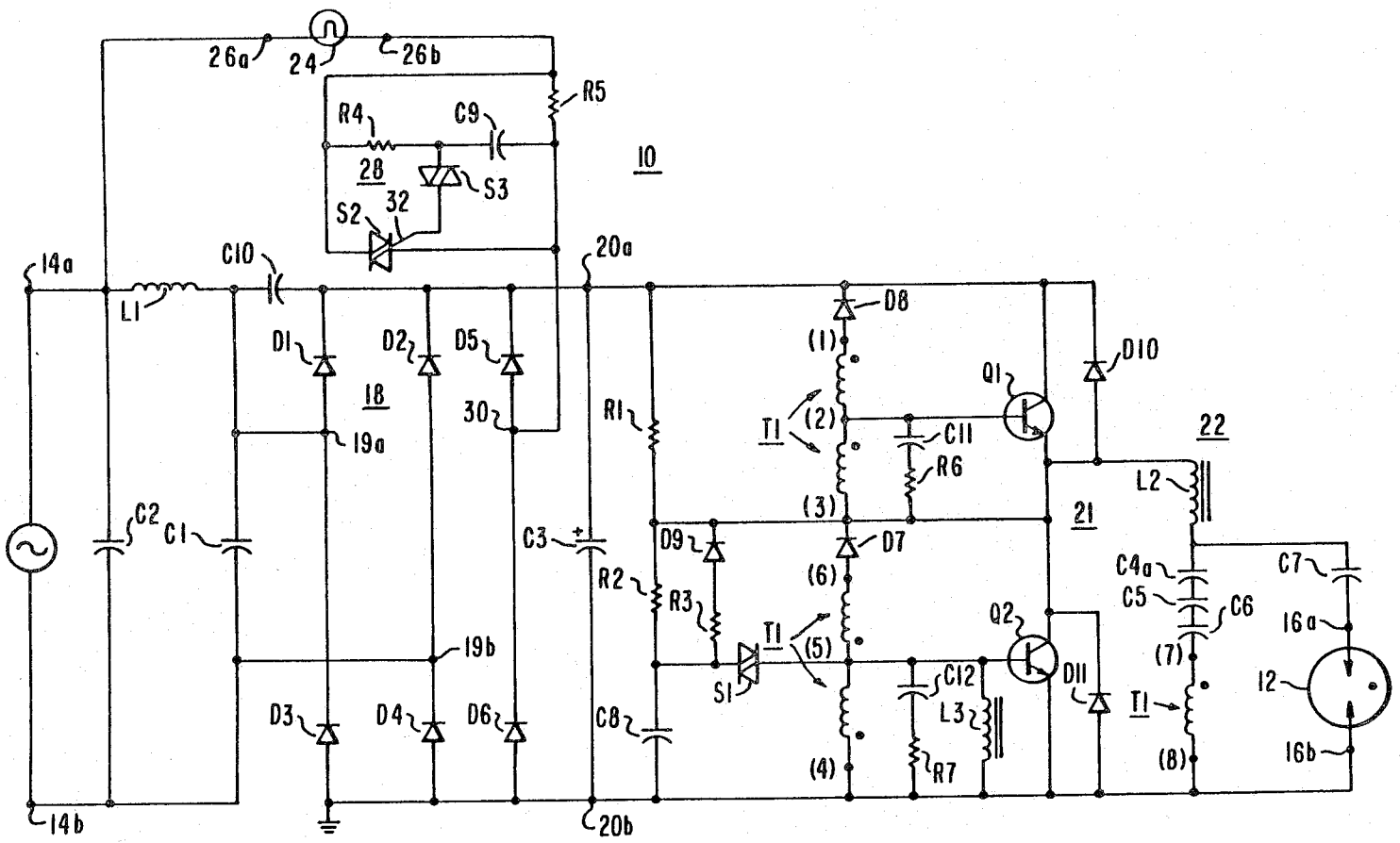
FIG. 2 is a detailed circuit diagram for the present apparatus.

The detailed circuit diagram for the apparatus 10 is shown in FIG. 2. As previously described, the series-connected current-limiting input inductor L1 and input capacitor C1 are connected across the apparatus input terminals 14*a*, 14*b* and the additional input capacitor C2 connects across the input terminals 14*a*, 14*b* to correct the power factor so that it at least approaches unity. The full-wave diode bridge rectifier means 18 comprises the diodes D1, D2, D3 and D4 with the input thereof connected across the input capacitor C1. The filter capacitor C3 connects across the output 20*a*, 20*b* of the bridge rectifier 18. The pair of additional series-connected diode means D5 and D6 are connected anode-to-cathode across the output 20*a*, 20*b* of the bridge rectifier 18 and in current-additive relationship with respect to the diodes D1, D2, D3 and D4 which comprise the bridge rectifier 18.

The inverter means 21 comprises the transistors Q1 and Q2 connected emitter to collector across the filter capacitor C3 and these operate to convert the current-limited DC energy to high frequency AC energy in order to operate the HID lamp 12, with a typical operating frequency being 15 to 20 KHz.

The output of the inverter 21 connects through high-voltage generating and variable impedance resonance circuit means 22 to the apparatus output terminals 16*a* and 16*b*. The resonance circuit means 22 comprises the inductor L2, the three series-connected capacitors C4*a*, C5 and C6 and the primary winding of current transformer T1. When the apparatus is first energized, the high Q of this resonant circuit generates a high voltage which is impressed across the apparatus output terminals 16*a*, 16*b* and is sufficient to start the HID lamp 12 when it is in a cold or warm condition. A typical Q of this reasonant circuit is 40 and a typical high voltage which is generated is 2,500 volts. The load impedance seen by the DC supply energizing the inverter is inversely proportional to the Q of the series resonant L-C-R circuit. Thus, as the Q goes up the inverter load impedance goes down so that the DC voltage across capacitor C3 is lower prior to lamp ignition (high Q condition). After the lamp ignites, the reverse is true because the lamp load lowers the circuit Q. Once the lamp is energized, the capacitor C7 is also included in circuit which decreases the resonant frequency to approximately 18 KHz, for example. In addition, prior to lamp starting, the impedance of the starting resonant circuit is relatively low so that the potential which is applied across the capacitor C3 is also low since the resonant circuit is effectively in shunt with the capacitor. After the HID lamp 12 is energized, its resistive load substantially lowers the Q of the resonant circuit thereby increasing the impedance thereof and this increases the voltage which is applied across the filter capacitor C3 in shunt therewith.

During the starting mode, a typical frequency is 25 to 30 KHz. This very high frequency permits higher starting voltages to be generated with less power input. After the lamp 12 starts, the resonant frequency is predetermined in order to operate the lamp in a stable condition. The capacitor C7 also provides DC blocking to prevent any tendency for the lamp to operate on DC.

The primary of the current transformer T1 is included in the resonant circuit means 22 and the secondaries of this transformer T1 provides base drive for the transistors Q1 and Q2 so that they oscillate at the frequency which is established by the resonant circuit means 22. The interconnections of the transformer T1 are shown as (1)–(8) on FIG. 2, with the "dotted" connections having the same voltage polarity. The remaining resistors and capacitors associated with the inverter means 21 are for the purpose of attenuating switching transients and the inductor L3 serves the purpose of carrying the inverter 21 through transient switching conditions. The additional resistors and capacitors are described in the component chart hereinafter. Diodes D7, D8 keep the transistors Q1, Q2 out of saturation.

The network R1 and R2 along with capacitor C8 serves the purpose of starting the inverter in its initial operation and the diac S1 conducts when the voltage thereacross is 40 volts, which provides the initial energization for the inverter 21. Diode D9 and the associated resistor R3 serves to clamp the voltage across capacitor C8 to a very low value once the inverter is operating.

As indicated hereinbefore, an incandescent lamp 24 serves the purpose of providing standby illumination, particularly after a power interruption or after the apparatus has been otherwise de-energized. The incandescent lamp 24 has a pair of input terminals **26*a*, 26*b* with the terminal 26*a* directly connected to the input terminal 14*a* of the ballast apparatus to which the input inductor L1 directly connects. A voltage-responsive control and switching means 28 connects between the other terminal 26*b* of the incandescent lamp 24 and the interconnection 30 between the anode and the cathode of the diodes D5, D6. This voltage responsive switching means 28 is responsive to the decreased voltage developed across the filter capacitor C3 when the HID lamp 12 is not operating in order to energize the incandescent lamp to provide standby lighting. When the HID lamp 12 is normally operating, however, the voltage-responsive control and switching means is responsive to the increased voltage developed across the filter capacitor C3 in order to prevent the incandescent lamp 24 from being energized. In this manner, standby incandescent lamp illumination is provided when the HID lamp 12** is not operating.

The voltage-responsive control and switching means 28 comprises a series-connected voltage-sensing resistor R4 and a capacitor C9 connected between the other terminal **26*b* of the incandescent lamp 24 and the interconnection 30 between the diodes D5 and D6. A triac S2 is connected in parallel with the resistor R4 and capacitor C9 and the interconnection between these elements is connected to the control terminal 32 of the triac S2 through a diac S3 which conducts when the voltage impressed thereacross is 40 volts. In this manner, when the voltage across C3 decreases due to the lowered impedance of the resonant circuit 22, which in turn results from the lamp 12 not operating, the incandescent lamp 24** is energized to provide standby illumination.

Due to the lowered impedance of the resonant circuit 22 when the HID lamp 12 is not operating, it is desirable that additional DC energy be supplied to the filter capacitor C3 to assist in lamp starting and the energization of the incandescent lamp 24 serves to accomplish this purpose.

Remaining elements include capacitor C10 which serves the purpose of line spike suppression and diodes D10 and D11 which function as recirculating diodes.

Following is a complete component chart for the foregoing circuit.

COMPONENT CHART

| Component | Value or Designation |
|---|---|
| L1 | 2.5 H |
| L2 | 3.55 mH |
| L3 | 560 μH |
| C1 | 1.0 μF, 400 V |
| C2 | 2.0 μF, 300 V |
| C3 | 20 μF, 450 V |
| C4a, C5, C6 | 0.028 μF, 600 V |
| C7 | 0.022 μF, 1 KV |
| C8 | 0.22 μF, 50 V |
| C9 | 0.68 μF, 50 V |
| C10 | 0.0039 μF, 1 KV |
| C11, 12 | 0.047 μF, 50 V |
| R1 | 100 KΩ, 0.5 W |
| R2 | 470 KΩ, 0.5 W |
| R3 | 10 KΩ, 0.5 W |
| R4 | 200 KΩ, 0.5 W |
| R5 | 470 KΩ, 0.5 W |
| R6, R7 | 11Ω, 105 W |
| D1–D6, D9 | IN5593 |
| D7, D8, D10, D11 | IN5617 |
| S1, S3 | HT40 |
| S2 | T2800D |
| | RCA |
| Q1, Q2 | 1R411 |
| T1 | 1–2, 45 T Secondary |
| | 2–3, 45 T Secondary |
| | 4–5, 45 T Secondary |
| | 5–6, 45 T Secondary |
| | 7–8, 15 T Primary |
| | Core: EI 187 Super Malloy |

It is envisioned that the preferred fixture design for utilizing the foregoing apparatus will provide for separate receptacles to receive the individual HID lamp and the individual incandescent lamp. The apparatus can also accommodate a separate HID lamp and incandescent lamp within the same unitary envelope. Also, the apparatus can be readily modified to operate from a 110–120 V power source by including a transformer at the input terminals.

What I claim is:

1. Ballast apparatus for operating HID lamp means at a high frequency and with a high power factor from an AC power source, said ballast apparatus comprising:

apparatus input terminals adapted to be connected across said source of AC power, and apparatus output terminals across which said HID lamp means is adapted to be connected;

series-connected current-limiting input inductor means and input capacitor means connected across said apparatus input terminals, said series-connected input inductor means and input capacitor means having predetermined reactance values at the frequency of the AC power source such that the series combination is tuned off resonance to pass a predetermined lagging current with the inductive reactance exceeding the capacitive reactance, and additional input capacitor means of predetermined reactance connected across said apparatus input terminals so that the electric energy drawn by said combined series-connected input inductor means and input capacitor means and said additional input capacitor means at least approaches unity power factor;

diode bridge rectifier means having an input connected across said series-connected input capacitor means; filter capacitor means directly connected across the output of said bridge-rectifier means, during operation of said apparatus said filter capacitor means exhibiting thereacross a DC potential which is current-limited by said series-connected current-limiting input inductor means and input capacitor means;

inverter means having an input connected across said filter capacitor means to convert said current-limited DC potential to high-frequency AC potential; and means including a high-voltage generating and variable impedance series inductor-capacitor resonant circuit connected across the output of the inverter means, a second capacitor connected in series with said output terminals across the capacitor of the resonant circuit so that when said HID lamp means is not operating said resonant circuit impresses a high-voltage across said apparatus output terminals to start said HID lamp means and said resonant circuit exhibits a relatively low impedance which substantially decreases the current-limited DC potential developed across said filter capacitor means, and wherein when said HID lamp means is normally operating there is applied across said apparatus output terminals a predetermined potential to maintain the operation of said HID lamp means and said resonant circuit exhibits a relatively high impedance whereby a substantially increased current-limited DC potential is produced across said filter capacitor means.

2. Starting and ballast apparatus for operating HID lamp means at a high frequency and with a high power factor from an AC power source and also for operating a supplemental incandescent lamp means during HID lamp means start-up and after interruption of said AC power when said AC power is again applied to said ballast apparatus but said HID lamp means cannot be started due to the residual heat-generated pressure therein resulting from operation prior to interruption of said AC power, said starting and ballast apparatus comprising:

apparatus input terminals adapted to be connected across said source of AC power, and apparatus output terminals across which said HID lamp means is adapted to be connected;

series-connected current-limiting input inductor means and input capacitor means connected across said apparatus input terminals, said series-connected input inductor means and input capacitor means having predetermined reactance values such that the series combination is tuned off resonance to pass a predetermined current with the inductive reactance exceeding the capacitive reactance, and additional input capacitor means of predetermined reactance connected across said apparatus input terminals so that the electric energy drawn by said combined series-connected input inductor means and input capacitor means and said additional input capacitor means at least approaches unity power factor;

full-wave diode bridge rectifier means having an input connected across said series-connected input capacitor means, filter capacitor means connected across the output of said bridge-rectifier means, during operation of said apparatus said filter capacitor means exhibiting thereacross a DC potential which is current-limited by said series-connected current-limiting input inductor means and input capacitor means, and a pair of additional series-connected diode means connected anode-to-cathode across said bridge-rectifier means output and in current additive relationship with respect to the diodes comprising said bridge-rectifier means;

inverter means having an input connected across said filter capacitor means to convert said current-limited DC energy to high-frequency AC energy potential to operate said HID lamp means, means coupling the output of said inverter means through high-voltage generating and variable impedance resonant circuit means to said apparatus output terminals, when said HID lamp means is not operating said resonant circuit means impresses a high-voltage across said apparatus output terminals to start said HID lamp means in the warm or cold condition and said resonant circuit means exhibits a relatively low impedance which substantially decreases the current-limited DC potential generated across said filter capacitor means, and when said HID lamp means is normally operating there is applied across said apparatus output terminals a predetermined potential as required to maintain the operation of said HID lamp means and said resonant circuit means exhibits a relatively high impedance which results in substantially increased current-limited DC potential being generated across said filter capacitor means; and said incandescent lamp means having a pair of terminals, one terminal of said incandescent lamp means adapted to be connected to the input terminal of said ballast apparatus to which said input inductor means directly connects, and voltage responsive control and switching means connected between the other terminal of said incandescent lamp means and the interconnection of the anode and cathode of said pair of additional diode means, said voltage-responsive control and switching means being responsive to the decreased voltage developed across said filter capacitor means when said HID lamp means is not operating to energize said incandescent lamp means, and when said HID lamp means is normally operating said voltage-responsive control and switching means is responsive to the increased voltage developed across said filter capacitor means to maintain said incandescent lamp means in a de-energized state; whereby incandescent lamp illumination is provided when said HID lamp means is not operating.

3. The starting and ballast apparatus as specified in claim 2, wherein during start-up of said HID lamp means, additional DC energy is supplied to said filter capacitor means through said operating incandescent lamp means to assist in establishing the normal operation of said HID lamp means.

4. The apparatus as specified in claim 2, wherein said high-voltage generating and variable-impedance resonant circuit means which couples the output of said inverter means to said apparatus output terminals comprises:

a high Q resonant circuit of predetermined resonant frequency comprising output inductor means and output capacitor means series connected across the output of said inverter means;

inverter drive means connected in series with said high Q resonant circuit to cause said inverter to operate at the resonant frequency of said resonant circuit means;

additional output capacitor means connected between one of said apparatus output terminals and the connection between said series-connected output inductor means and said output capacitor means; and when said apparatus is initially energized, but before said HID lamp means is started, the high voltage generated by said high Q resonant circuit is applied across said apparatus output terminals to cause said HID lamp means to start when in a cold or warm condition, and after said HID lamp means is operating, said additional output capacitor means is included in series circuit with said HID lamp means which lowers the resonant frequency of said resonant circuit means to a predetermined frequency as desired for HID lamp operation, with the added resistance of the operating HID lamp means substantially increasing the impedance of said resonant circuit means.

5. The apparatus as specified in claim 4, wherein said inverter drive means comprises the primary winding of a transformer means, a pair of transistor means connected emitter-to-collector across the output of said filter capacitor means, and wherein secondary windings of said transformer means connect to the bases of said transistor means to provide base drive therefor at the frequency established by said high-voltage generating and variable impedance resonant circuit means.

6. The apparatus as specified in claim 2, wherein said voltage responsive control and switching means comprises a series-connected voltage-sensing resistor means and capacitor means connected between the other terminal of said incandescent lamp means and the interconnection of the anode and cathode of said pair of additional diode means, triac means connected in parallel with said series-connected voltage-sensing resistor means and capacitor means, and the interconnection between said series-connected voltage-sensing resistor means and capacitor means connects to a control terminal of said triac means through diac means, whereby when the voltage across said filter capacitor means is less than a predetermined value, the resulting increased voltage impressed across said series-connected voltage-sensing resistor means and capacitor means causes said diac means to conduct to switch said triac means to a conducting state which energizes said incandescent lamp means.

7. A high-frequency high-power factor ballast apparatus for a HID lamp comprising:

apparatus input terminals for connection to a source of AC voltage, and apparatus output terminals for connection to a HID lamp;

a first inductor and a first capacitor connected in series circuit across the apparatus input terminals and having reactance values at the frequency of the AC source to draw a sinusoidal lagging current therefrom;

a second capacitor connected across the apparatus input terminals so that the electric energy drawn by the combination of said first inductor and said first and second capacitors approaches unity power factor;

a bridge rectifier circuit having an input connected across the first capacitor and an output;

a filter capacitor directly connected across the output of the bridge rectifier circuit so that a DC potential is developed across the filter capacitor that is current-limited by said series circuit including the first inductor and the first capacitor;

an inverter circuit coupled to said filter capacitor to generate a high-frequency AC potential at an output thereof;

a variable impedance resonant circuit coupling the inverter circuit output to the apparatus output terminals and arranged so that a first high-frequency AC voltage is developed at said apparatus output terminals determined by the resonant frequency of said resonant circuit and prior to ignition of a HID lamp connected thereto and a second high-frequency AC voltage of lower frequency than the first high-frequency AC voltage is developed at said apparatus output terminals when the HID lamp is in operation and due to a change in the resonant frequency of the resonant circuit.

8. A ballast apparatus as claimed in claim 7, wherein said resonant circuit comprises a second inductor and a third capacitor connected in series across the output of the inverter circuit to form a high Q series resonant circuit, and a fourth capacitor coupled between one of said apparatus output terminals and a junction point between said second inductor and the third capacitor so that when the lamp is in operation the fourth capacitor and the lamp form a series circuit coupled to the series resonant circuit so as to lower the overall resonant frequency of the resonant circuit, the frequency of said second high frequency AC voltage being determined by the resonant frequency of the resonant circuit.

9. A ballast apparatus as claimed in claim 7, further comprising circuit means coupled between one apparatus input terminal and said filter capacitor for supplying additional DC energy to the filter capacitor prior to ignition of the HID lamp thereby to assist in starting said lamp.

10. A ballast apparatus as claimed in claim 7, further comprising an incandescent lamp coupled to one apparatus input terminal and to a voltage-controlled switching means which switches the incandescent lamp on and off as a function of the voltage level across said filter capacitor, said resonant circuit exhibiting a relatively low impedance when the HID lamp is not operating which thereby decreases the DC voltage across the filter capacitor whereby the voltage-controlled switching means is responsive to the decreased DC voltage on the filter capacitor to energize the incandescent lamp, and wherein the resonant circuit exhibits a relatively high impedance when the HID lamp is operating thereby to increase the DC voltage across the filter capacitor whereby the voltage-controlled switching means is responsive to said increased DC voltage on the filter capacitor to de-energize the incandescent lamp.

11. A ballast apparatus as claimed in claim 7, wherein said resonant circuit comprises a second inductor and a third capacitor connected in series across the output of the inverter circuit to form a high Q series resonant circuit, and a fourth capacitor coupled in circuit with said apparatus output terminals so that when the lamp is in operation the fourth capacitor and the lamp form a series circuit coupled across the third capacitor whereby the resonant circuit exhibits a relatively high impedance so as to develop a higher DC voltage across the filter capacitor than appears across the filter capacitor prior to ignition of the lamp.

12. A high-frequency ballast apparatus for a HID lamp comprising:

apparatus input terminals for connection to a source of AC voltage, and apparatus output terminals for connection to a HID lamp;

a first inductor and a first capacitor connected in series circuit across the apparatus input terminals;

a bridge rectifier circuit having an input connected across the first capacitor and an ouput;

a filter capacitor connected across the output of the bridge rectifier circuit so that a DC potential is developed across the filter capacitor that is current-limited by said series circuit including the first inductor and the first capacitor;

an inverter circuit coupled to said filter capacitor to generate a high-frequency AC potential at an output thereof;

a variable impedance resonant circuit coupling the inverter circuit output to the apparatus output terminals;

an incandescent lamp coupled to one apparatus input terminal and to a voltage-controlled switching means which switches the incandescent lamp on and off as a function of the voltage level across said filter capacitor;

said resonant circuit exhibiting a variation in impedance as a function of the operating condition of a HID lamp connected to the apparatus output terminals thereby to cause a variation in the DC voltage across the filter capacitor so that the voltage-controlled switching means energizes the incandescent lamp when the HID lamp is not operating and de-energizes the incandescent lamp when the HID lamp is operating.

13. A ballast apparatus as claimed in claim 7, wherein the reactance values of the first inductor and first capacitor at the AC source frequency draw a sinusoidal lagging current from the input terminals, and wherein the filter capacitor is directly connected across the output of the bridge rectifier circuit.

14. A ballast apparatus as claimed in claim 7, further comprising a pair of series connected diodes connected in parallel with the filter capacitor, and an incandescent lamp coupled between one of said input terminals and a junction point between said pair of diodes.

15. A ballast apparatus as claimed in claim 7, further comprising a pair of series connected diodes connected in parallel with the filter capacitor, and voltage responsive control means coupled between one of said input terminals and a junction point between said pair of diodes.

16. A high frequency ballast apparatus for an electric discharge lamp comprising:

input terminals for connection to a source of AC voltage, and output terminals for connection to a discharge lamp;

an AC to DC rectifier circuit having an input and an output;

a filter capacitor coupled to the output of the rectifier circuit independently of the voltage level at said rectifier circuit output;

an LC circuit coupled between the input of the rectifier circuit and the input terminals so as to develop a current limited DC voltage across the filter capacitor, said LC circuit providing close to unity power factor at the input terminals;

an inverter circuit coupled to said filter capacitor to generate a high frequency AC potential at an output thereof;

an LC resonant circuit coupling the inverter circuit output to the output terminals so that prior to ignition of a discharge lamp coupled to the output terminals the resonant circuit impresses a high voltage across the output terminals sufficient to ignite a discharge lamp, said resonant circuit exhibiting a relatively low impedance prior to ignition so that a relatively low DC voltage is developed across the filter capacitor, said resonant circuit exhibiting a relatively high impedance after lamp ignition so that a relatively high DC voltage is developed across the filter capacitor.

17. A ballast apparatus as claimed in claim 16 wherein the discharge lamp is a HID lamp with non-preheatable electrodes coupled to said output terminals, and further comprising a voltage responsive control means coupling an input terminal to the filter capacitor.

18. A ballast apparatus as claimed in claim 16 wherein the resonant circuit has a first resonant frequency prior to lamp ignition such that the inverter circuit develops a first high frequency AC voltage at the output terminals prior to ignition of a lamp and of a frequency determined by said first resonant frequency, said resonant circuit having a second lower resonant frequency after lamp ignition such that the inverter circuit develops a second high frequency AC voltage at the output terminals of a frequency determined by said second resonant frequency.

* * * * *

UNITED STATES PATENT AND TRADEMARK OFFICE

CERTIFICATE OF CORRECTION

PATENT NO. : 4,506,195

DATED : March 19, 1985

INVENTOR(S) : ROBERT T. ELMS

It is certified that error appears in the above-identified patent and that said Letters Patent is hereby corrected as shown below:

In the Abstract line 6, change "to" to --so--;

line 14, delete "inverter".

In the Claims:

Claim 2, line 47, delete "potential".

Claim 7, line 9, delete "sinusoidal";

Line 18, delete "directly";

line 30 after "terminals" insert --of a frequency--.

Signed and Sealed this

Twenty-third Day of December, 1986

*Attest:*

DONALD J. QUIGG

*Attesting Officer* *Commissioner of Patents and Trademarks*